US006550857B1

(12) United States Patent
Canton

(10) Patent No.: US 6,550,857 B1
(45) Date of Patent: Apr. 22, 2003

(54) CONVERTIBLE HIGH CHAIR AND ROCKER

(76) Inventor: Thurman Canton, 16743 Lost Quail Dr., Missouri City, TX (US) 77489

( * ) Notice: Subject to any disclaimer, the term of this patent is extended or adjusted under 35 U.S.C. 154(b) by 0 days.

(21) Appl. No.: 10/059,721

(22) Filed: Jan. 31, 2002

(51) Int. Cl.[7] ..... A47D 1/08
(52) U.S. Cl. ..... 297/132; 297/131
(58) Field of Search ..... 297/131, 132

(56) References Cited

U.S. PATENT DOCUMENTS

| | | | | |
|---|---|---|---|---|
| 397,861 A | | 2/1889 | Gifford | |
| 604,941 A | * | 5/1898 | Paine | 297/132 |
| 677,383 A | | 7/1901 | Thompson | |
| 682,961 A | | 9/1901 | Smith | |
| 730,306 A | * | 6/1903 | Smith | 297/132 |
| 736,180 A | | 8/1903 | Washburn | |
| 775,387 A | * | 11/1904 | Thompson | 297/132 |
| 776,387 A | | 11/1904 | Thompson | |
| 877,204 A | | 1/1908 | Lepard | |
| 3,269,771 A | | 8/1966 | Erdos | |
| 4,394,046 A | | 7/1983 | Irwin et al. | |

* cited by examiner

*Primary Examiner*—Peter R. Brown
(74) *Attorney, Agent, or Firm*—Kenneth A. Roddy

(57) ABSTRACT

A convertible high chair and rocker supported by lateral pairs of curved pivotally connected legs that are extendable between a raised high chair configuration and serve as rockers when the chair lowered. Laterally opposed pairs of elongate longitudinally curved inner and outer legs are joined in laterally opposed parallel relation, and pivotally connected by a mutual pivot connection. In a raised high chair configuration, latch hook portions are engaged with catch elements to secure the leg members in their raised position and prevent pivotal movement. To lower the chair, the hook portions of the latches are disengaged from the catch elements by pulling the knob and, as the chair is lowered, the outer legs pivot about their pivot connection with the lateral side members, and the inner and outer legs pivot about their mutual pivot connection in a scissors fashion to form rockers with the bottom of the lateral side members resting on the top surface of the inner legs and the outer legs disposed parallel with the inner legs.

5 Claims, 6 Drawing Sheets

CONVERTIBLE HIGH CHAIR AND ROCKER

BACKGROUND OF THE INVENTION

1. Field of the Invention

This invention relates generally to chairs that are convertible into various forms for multiple uses, and more particularly to a chair that can be converted from a high chair into a rocking chair and vise versa.

2. Brief Description of the Prior Art

Convertible chairs such as chairs that are convertible between a high chair configuration and a rocking chair configuration are known in the art. There are several patents that disclose various chair constructions which are convertible between a high chair configuration and a rocking chair configuration.

Gifford, U.S. Pat. No. 397,851 discloses a child's adjustable chair. The rocker elements permanently support the seat on accordion type folding cross members which can be raised and lowered as desired. The lower cross members act to prevent movement on the rockers when the chair is in the higher positions.

Thompson, U.S. Pat. Nos. 677,382, 677,383, and 775,387 disclose convertible high chair and rockers, wherein the legs become the rocker elements and are hinged together. The seat of the chair has a rigid base with depending straight legs that are secured at their lower ends to lateral side bars. In these chairs, one pair of legs curve downward and to the rear, and another pair of legs curve downward and to the front, the legs forming the rocker elements are pivotally connected to the lateral side bars of the base. In the high chair elevated position, the side bars of the base are supported at the top end of the legs and the seat, and thus the occupant, is disposed a distance above the side bars and above the point of support.

Washburn, U.S. Pat. No. 736,180 discloses a convertible high chair and rocker, wherein the seat of the chair has a rigid base with depending straight legs that are secured at their lower ends to lateral side bars. The curved legs that become the rocker elements and are hinged together and provided with a slot and pin arrangement, and one pair of curved legs is provided with catches having a shoulder extension that protrudes from the end of the legs. When the chair is raised from the lower to the upper position, the pin and slot, or the shoulder extension, will limit the angular motion of the legs, and hooks on the side bars will engage the catches to lock the legs to the side bars of the base. In the high chair elevated position, the side bars of the base are supported at the top end of the legs and the seat, and thus the occupant, is disposed a distance above the side bars and above the point of support.

Smith, U.S. Pat. No. 682,961, and Lepard, U.S. Pat. No. 877,204 disclose convertible high chair and rocker construction having two front legs that curve downward and to the rear, and two rear legs that curve downward and to the front, and the legs form the rocker elements.

Erdos, U.S. Pat. No. 3,269,771 discloses a triply convertible chair having two pairs of long, curved rocker elements which hinge and pivot together is a wide variety of ways.

Irwin et al, U.S. Pat. No. 4,394,046 discloses a convertible rocker and high chair. A chair portion is connected to two pairs of extendable, crossing arms that in turn are connected to two pairs of rocker elements. Locking pawls and pivoting connections allow the chair portion to be raised into a high chair configuration. The chair can be lowered and the arms and rocker elements fold together as the rocker elements contact the ground.

The present invention is distinguished over the prior art in general, and these patents in particular by the present convertible high chair and rocker which is supported by lateral pairs of curved pivotally connected legs that are extendable between a raised high chair configuration and serve as rockers when the chair lowered. The chair has a rigid seat, back rest, lateral arm rests, and lateral side members at the bottom end of vertical legs depending from an underside of the seat. Laterally opposed pairs of elongate longitudinally curved inner and outer legs are joined in laterally opposed parallel relation, and pivotally connected by a mutual pivot connection. Each outer leg is pivotally connected to a respective lateral side member to pivot relative thereto. An arcuate catch element is secured at one end of each inner leg. A latch member is pivotally connected to an inner facing side of each lateral side member and has a rear end with a depending hook portion. The latch member rear ends are joined together by a transverse rung that is raised and lowered by a spring biased rod having a knob at its outer end. In a raised high chair configuration, the latch hook portions are engaged with the catch elements to secure the leg members in their raised position and prevent pivotal movement. To lower the chair, the hook portions of the latches are disengaged from the catch elements by pulling the knob and, as the chair is lowered, the outer legs pivot about their pivot connection with the lateral side members, and the inner and outer legs pivot about their mutual pivot connection in a scissors fashion to form rockers with the bottom of the lateral side members resting on the top surface of the inner legs and the outer legs disposed parallel with the inner legs.

SUMMARY OF THE INVENTION

It is therefore an object of the present invention to provide a chair that is convertible between a raised high chair configuration and a lowered rocker configuration.

It is another object of this invention to provide a convertible high chair and rocker that is easily and quickly manually converted between a high chair configuration and a rocker configuration without the use of tools.

Another object of this invention is to provide a convertible high chair and rocker that is easily and quickly raised and lowered by simply pulling a knob.

Another object of this invention is to provide a convertible high chair and rocker in a single piece of furniture that has the advantages and dual utility of both configurations.

Another object of this invention is to provide a convertible high chair and rocker that has a safety latch mechanism that automatically secures the legs in their raised position to prevent accidental collapse.

A further object of this invention is to provide a convertible high chair and rocker wherein the seat is positioned relative to the upper portion of the legs in their raised position to provide stable support of the occupant.

A still further object of this invention is to provide a convertible high chair and rocker that is simple in construction, inexpensive to manufacture, and rugged and reliable in operation.

Other objects of the invention will become apparent from time to time throughout the specification and claims as hereinafter related.

The above noted objects and other objects of the invention are accomplished by the present convertible high chair and rocker which is supported by lateral pairs of curved pivotally connected legs that are extendable between a raised high chair configuration and serve as rockers when the chair lowered. The chair has a rigid seat, back rest, lateral arm rests, and lateral side members at the bottom end of vertical legs depending from an underside of the seat. Laterally opposed pairs of elongate longitudinally curved inner and outer legs are joined in laterally opposed parallel relation, and pivotally connected by a mutual pivot connection. Each outer leg is pivotally connected to a respective lateral side member to pivot relative thereto. An arcuate catch element is secured at one end of each inner leg. A latch member is pivotally connected to an inner facing side of each lateral side member and has a rear end with a depending hook portion. The latch member rear ends are joined together by a transverse rung that is raised and lowered by a spring biased rod having a knob at its outer end. In a raised high chair configuration, the latch hook portions are engaged with the catch elements to secure the leg members in their raised position and prevent pivotal movement. To lower the chair, the hook portions of the latches are disengaged from the catch elements by pulling the knob and, as the chair is lowered, the outer legs pivot about their pivot connection with the lateral side members, and the inner and outer legs pivot about their mutual pivot connection in a scissors fashion to form rockers with the bottom of the lateral side members resting on the top surface of the inner legs and the outer legs disposed parallel with the inner legs.

DESCRIPTION OF THE PREFERRED EMBODIMENT

Figure 1:
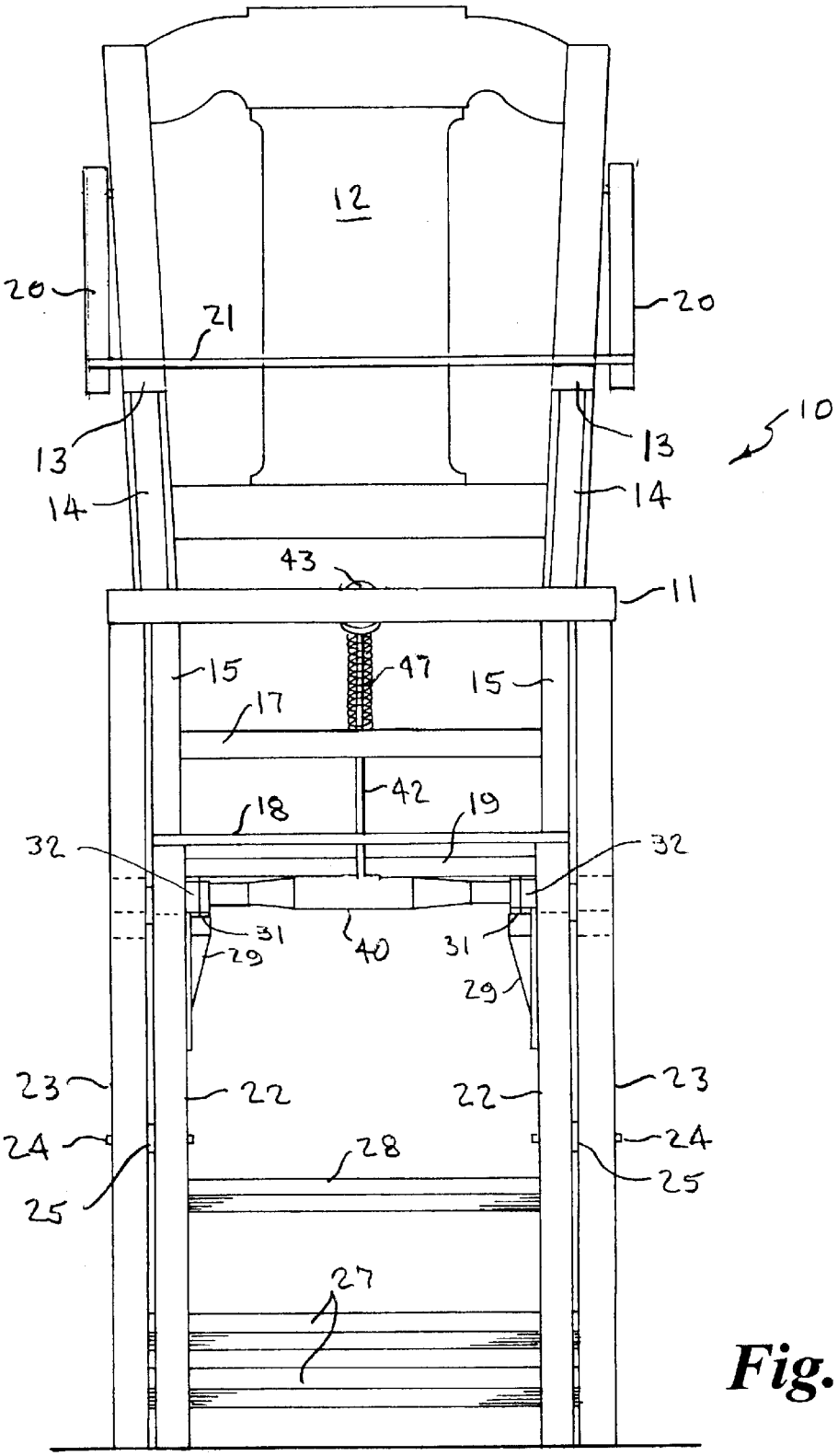
FIG. 1 is a front elevation of the convertible high chair and rocker in accordance with the present invention, shown in the raised high chair configuration.
Figure 2:
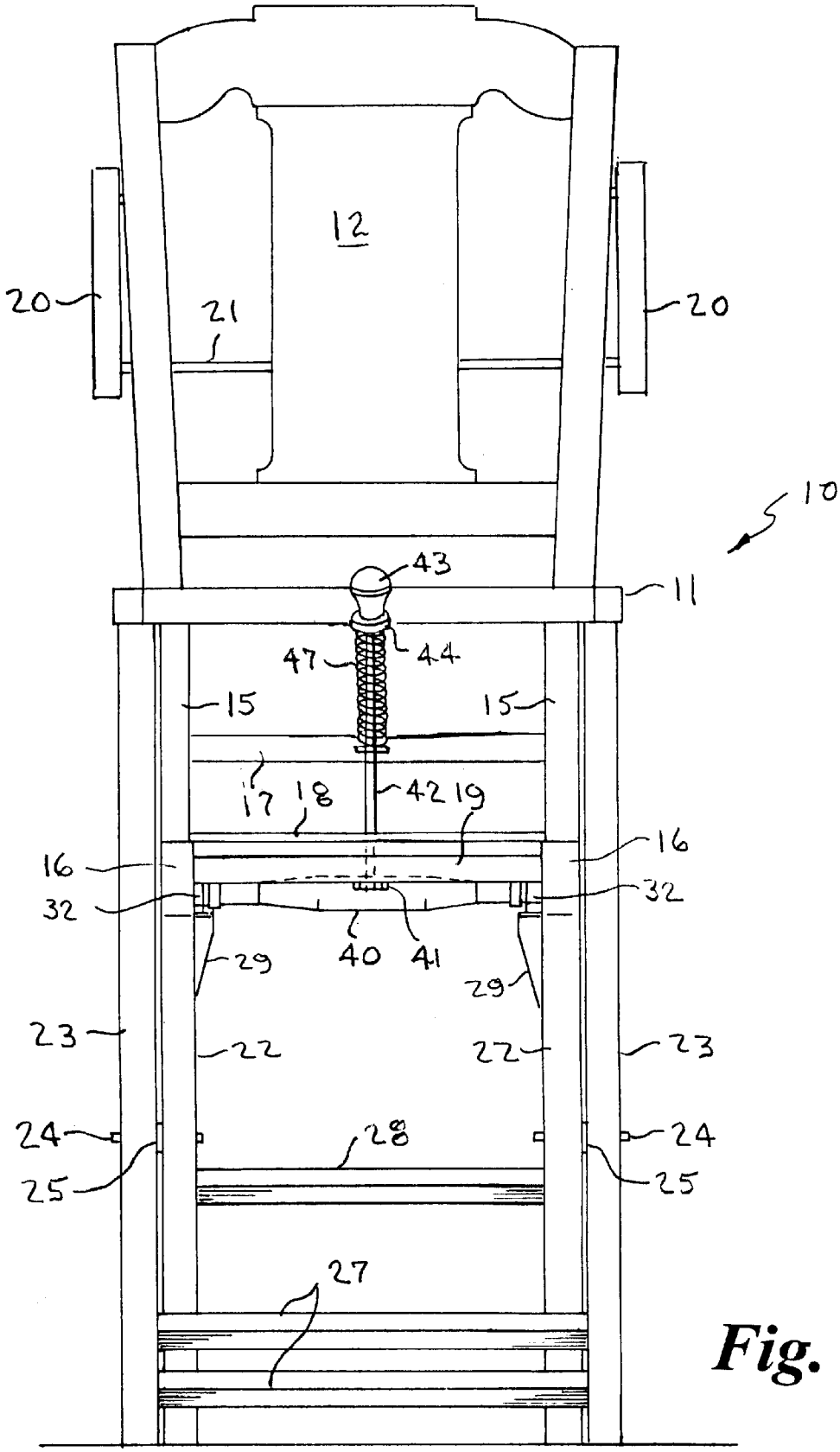
FIG. 2 is a rear elevation of the convertible high chair and rocker, shown in the raised high chair configuration.
Figure 3:
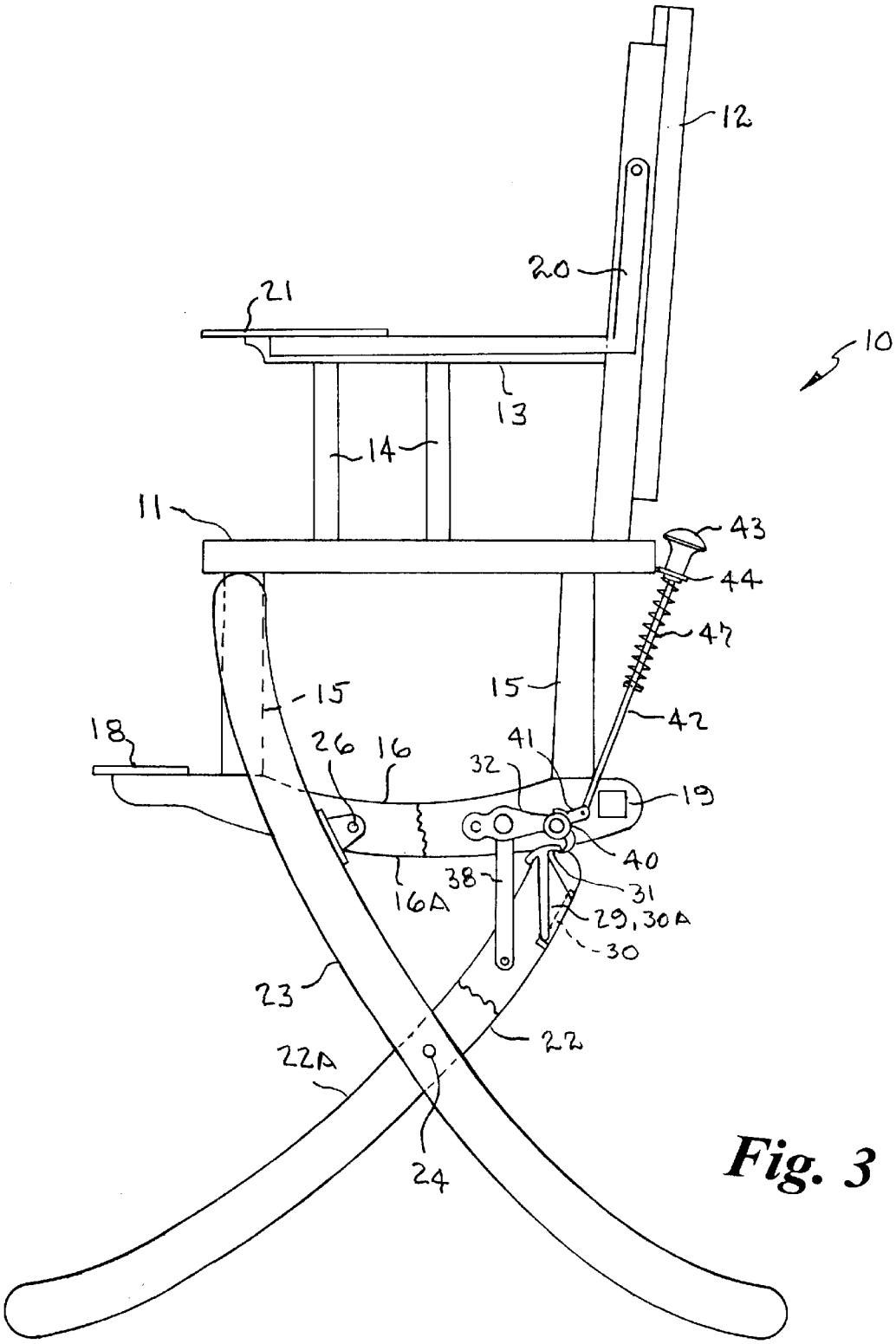
FIG. 3 is a side elevation of the convertible high chair and rocker in the raised high chair configuration, partially cut away to show the inside face of one lateral side member of the chair and the latch mechanism.
Figure 4:
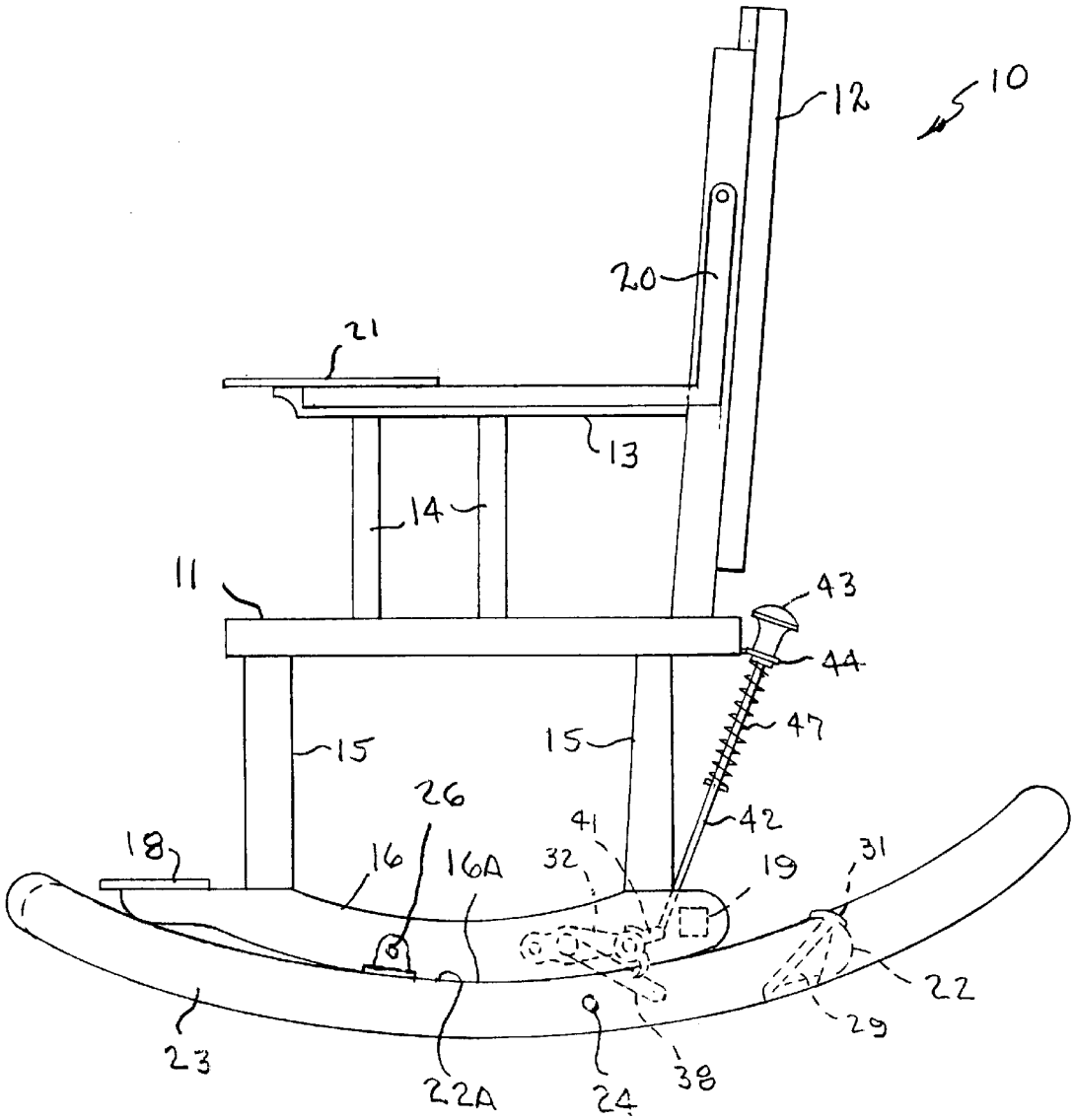
FIG. 4 is a side elevation of the convertible high chair and rocker, shown in the lowered rocker configuration.

Referring to the drawings by numerals of reference, there is shown in FIGS. 1 and 2, a preferred convertible high chair and rocker 10, shown in the raised high chair configuration. In the following description, the terms front and forward refer to the direction faced by an occupant of the chair. The chair 10 has a rigid seat 11, a back rest 12 extending upwardly from a rear end of the seat, a pair of arm rests 13 extending forwardly from the lateral sides of the back rest and joined to the seat 11 by vertical bars 14. A pair of rigid generally vertical legs 15 spaced inwardly from each lateral side of the seat 11 depend from the underside of the seat, and each pair is secured it their lower ends to a respective lateral side member 16. A transverse cross member 17 is secured between the front pair of legs 15. The lateral side members 16 are joined together by a generally rectangular foot rest 18 secured transversely across the top of their front ends and a transverse cross member 19 is secured between their back ends. As seen in FIGS. 3 and 4, the bottoms of the lateral side members 16 are curved longitudinally as indicated at 16A.

A pair of generally L-shaped arms 20 are pivotally connected at their upper ends to the lateral sides of the back rest 12 and their lower ends extend forwardly laterally adjacent to the arm rests 13. A generally rectangular tray 21 is secured transversely across the top forward portion of the arms 20. The L-shaped arms 20 and tray 21 may be pivoted upward and rearward to permit access to the seat 11.

In the raised position, the chair seat 11 is supported by laterally opposed pairs of inner and outer legs 22 and 23, respectively. The inner and outer legs 22 and 23 are longitudinally curved to form rockers for the chair when they are in the lowered position, as described hereinafter. The curvature of the upper side 22A of the inner legs 22 is approximately the same curvature as the bottom 16A of the lateral side members 16 so that when the chair is in the lowered position, the curved bottom 16A of the lateral side members 16 will rest on the curved top surface 22A of the inner legs 22. Each pair of inner and outer legs 22, 23 are pivotally joined together by a mutual pivot connection 24 with a thin washer 25 installed between their opposed facing surfaces to reduce friction.

The upper portions of the outer legs 23, above the mutual pivot connection 24, are longer than the upper portion of the inner legs 22 and are pivotally connected to the outer side of the lateral side members 16 by pivot connection 26. The lower portions of the outer legs 23, below the pivot connection 24, are rigidly secured together in parallel laterally spaced relation by a pair of transverse cross members 27 extending therebetween. The lower portions of the inner legs 22, below the pivot connection 24, are rigidly secured together in parallel laterally spaced relation by a pair of transverse cross members 28 extending therebetween.

Figure 5A:
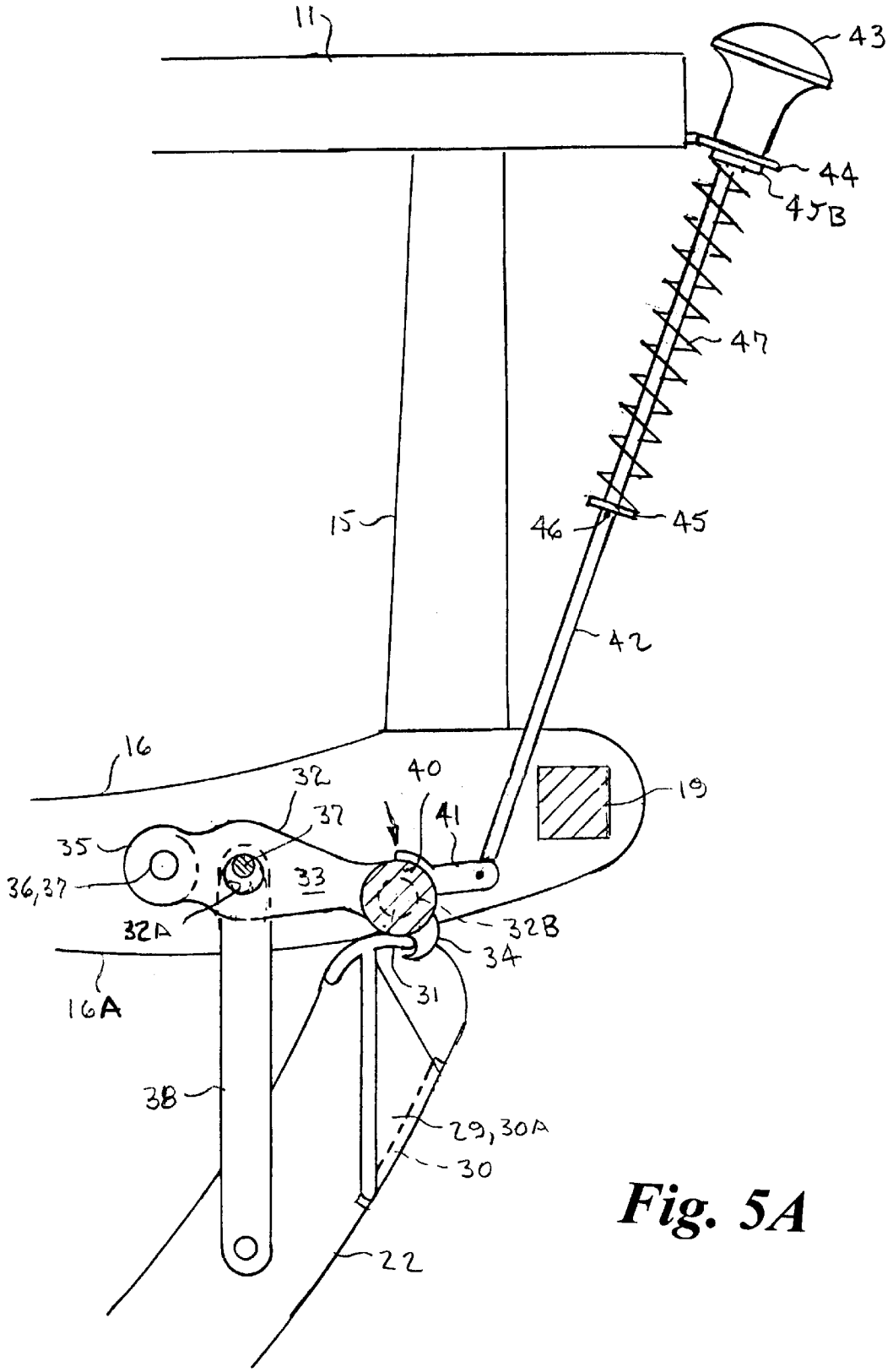
FIGS. 5A and 5B are side elevation views of the inside face of one lateral side member of the chair, showing the latch mechanism in a latched position and unlatched position, respectively.
Figure 5B:
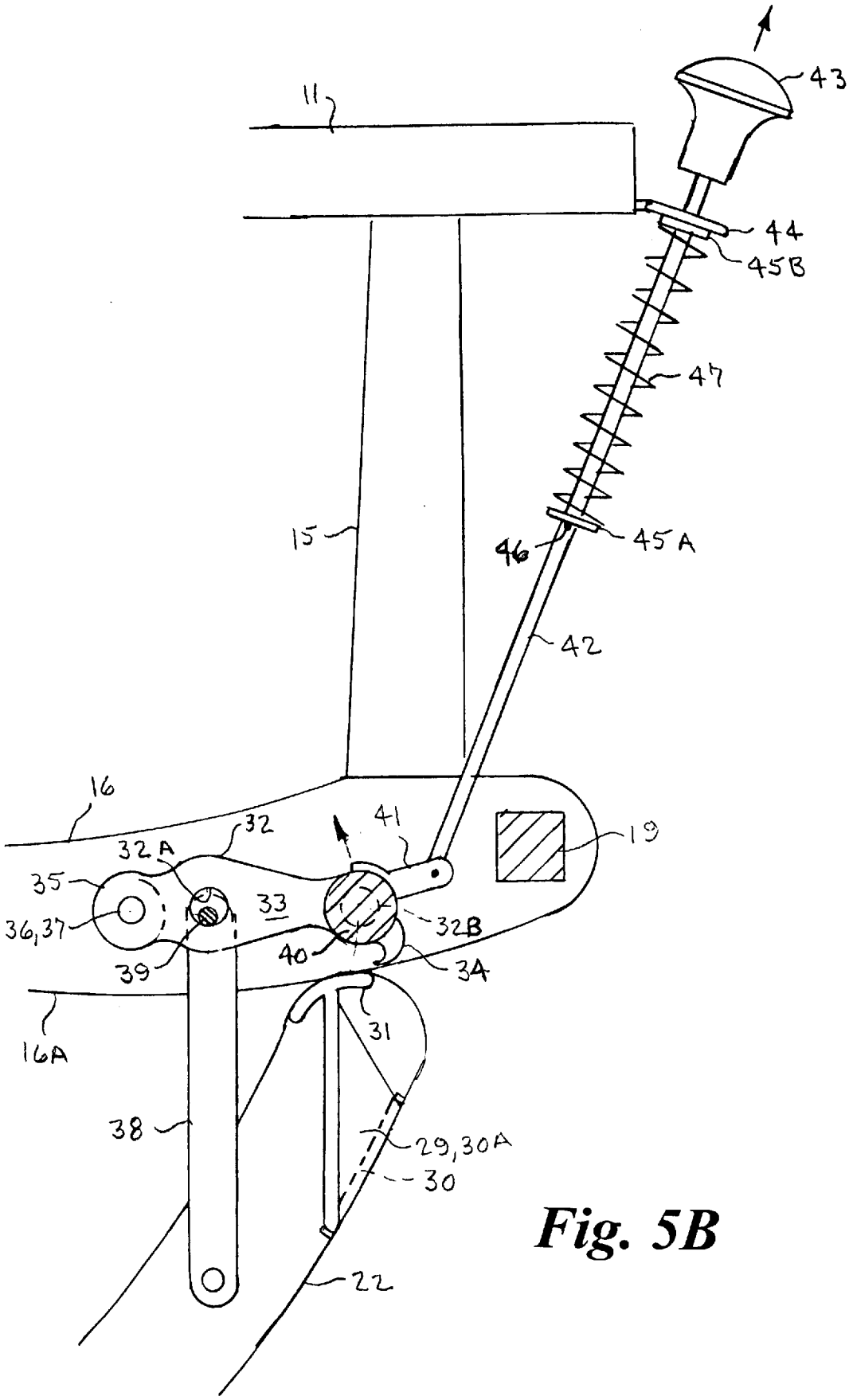

As best seen in FIGS. 3, 5A and 5B, a metal catch bracket 29 is secured near the top or outer end of each inner leg 22. Each catch bracket 29 has a flat rectangular portion 30 which is secured by screws into a recess on the underside of each inner leg 22 and a side portion 30A that extends along the inside facing surface of each inner leg member and terminates in an arcuate catch element 31. A metal latch member 32 is pivotally mounted on the inside facing surface of each lateral side member 16. Each latch member 32 has a flat central body portion 33 with curved hook 34 at one end and a cylindrical boss 35 protruding laterally from its opposed end. Each latch member 32 is pivotally mounted with its laterally protruding cylindrical boss 35 facing the inner surface of the respective lateral side member 16, by a threaded fastener 36 installed through a hole 37 in the boss 35 such that a space is formed between the inner surface of the lateral side member and the flat central body portion 33 of the latch member 32.

A flat rectangular link 38 is pivotally connected at its lower end to the inside facing surface of each inner leg 22 and its upper end is disposed in the space between the inner surface of the respective lateral side member 16 and the flat central body portion 33 of the latch member 32. The upper end of the link 38 is pivotally connected to the flat main body portion 33 of the latch member 32 by a headed fastener, such as a bolt installed through a hole 32A in the main body portion 33 with a washer and nut installed on its shank 39. In FIGS. 5A and 5B, only the fastener shank 39 is shown to avoid confusion and more clearly illustrate its function. The shank 39 of the fastener is smaller in diameter than the hole 32A to form a relatively loose pivotal connection that allows the latch member 32 to pivot a short distance relative to the link 38.

Referring additionally to FIGS. 1 and 2, the free ends of the laterally opposed latch members 32 are joined together by a transverse rung 40 having its opposed ends secured in holes 32B in their free ends near the curved hook 34. A yoke bracket 41 is secured to the transverse rung 40 intermediate its ends. A rod 42 having a knob 43 at its upper end extends downwardly through an eye 44 secured to the back end of the seat 11 and its lower end is pinned through the ears of the yoke bracket 41. As best seen in FIGS. 5A and 5B, a first washer 45A installed on the rod 42 is supported on a retaining pin 46 extending transversely through the rod a distance beneath the eye 44. A compression spring 47 is mounted on the rod 42 with its upper end engaged on the underside of a second washer 45B installed on the rod beneath the underside of the eye 44 and its lower end engaged on the washer 45A as to normally spring bias the rung 40 and free ends of the latch members 32 in a downward position (FIG. 5A).

As best seen in FIGS. 3 and 5A, when the chair 10 is in the raised position, free ends of the latch members 32 are biased downwardly with the curved hook 34 at their free ends engaged with the arcuate catch element 31 of the catch bracket 29 to secure the top or outer end of each inner leg 22 against the underside of the respective lateral side member 16. The top ends of the outer legs 23 are engaged on the underside of the seat 11 near its forward end, and an upper portion of the outer legs is disposed laterally adjacent to the lateral sides 16 and vertical legs 15, such that a forward portion of the seat is disposed between the upper portion of said outer legs to provide stable lateral support. The hooks 34 of the latch members 32 prevent rearward travel of the inner legs 22 and thus pivotal movement of the inner and outer legs is prevented.

As best seen in FIGS. 4 and 5B, to lower the chair, the knob 34 at the upper end of the rod 42 is pulled upward against the pressure of the spring 47. As the rod 42 is raised, the rung 40 and the free ends of the latch members 32 are pivoted in an arc about the fasteners 36 extending through the cylindrical bosses 35 at their pivotally connected ends. Because the shank 39 of the fastener at the upper end of the links 38 is smaller in diameter than the hole 32A in the latch members 32, the relatively loose pivotal connection allows the latch members to pivot a short distance relative to the links 38. As the free ends of the latch members 32 are pivoted upwardly, the curved hooks 34 at their free ends become disengaged from the arcuate catch element 31 of the catch brackets 29 to release the top or outer end of the inner legs 22, and the chair is lowered.

As the chair is lowered, the inner legs 22 pivot about the pivot connection 24, and the outer legs 23 pivot about the pivot connection 24, such that the inner and outer legs move relative to each outer in a scissors fashion about the pivot connection 24. The links 38 pivotally connected at each end between the inner legs 22 and the latch members 32 maintain the inner legs 22 connected with the upper portion of the chair, but allow the pivoting action and guide the legs in their movement. When chair is in its lowermost position, the inner and outer legs 22 and 23 form rockers with the curved bottom 16A of the lateral side members 16 resting on the curved top surface 22A of the inner legs 22 and the outer legs 23 parallel with the inner legs (FIG. 4).

To raise the chair from its lowered rocking chair configuration, the upper portion of the chair is lifted upwardly and the pivoting action of the inner and outer legs 22 and 23 described above is reversed. As the chair approaches its uppermost position, the outer surface of the arcuate catch element 31 of the catch brackets 29 at the outer or top end of the inner legs 22 slide forwardly against the underside of the latch hooks 34, raising the free ends of the latch members 32 and the transverse rung 40 upwardly against the pressure of the spring 47. As the back end of the arcuate catch elements 31 of the catch brackets 29 clear the underside of the hooks 34, the spring pressure causes the hooks to snap downwardly and engage the back end of the catch elements 31, thus latching the legs in their raised position.

While this invention has been described fully and completely with special emphasis upon a preferred embodiment, it should be understood that within the scope of the appended claims the invention may be practiced otherwise than as specifically described herein.

What is claimed is:

1. A chair convertible between a raised high chair configuration and a lowered rocking chair configuration, comprising:

a chair having a rigid seat, a back rest extending upwardly from a back end of the seat, lateral arm rests extending forwardly from the back rest, laterally opposed generally vertical legs depending from an underside of the seat, and first and second lateral side members secured to lower ends of said vertical legs, each of said lateral side members having a longitudinal curved bottom surface;

laterally opposed pairs of elongate longitudinally curved inner and outer legs joined in laterally opposed parallel relation by transverse cross members extending therebetween, the inner and outer legs of each said pair pivotally connected together by a mutual pivot connection intermediate their ends to form rockers when the chair is lowered, and each of said outer legs pivotally connected near a first end to an outer facing side of a respective said lateral side member to pivot relative thereto;

a pair of arcuate catch elements, each secured at a first end of a respective said inner leg member;

a pair of laterally opposed latch members, each having a forward end pivotally connected to an inner facing side of a respective one of said lateral side members and having a rear end with a depending hook engageable with a respective said arcuate catch element when said chair is raised;

a transverse rung secured between said latch member rear ends joining them together;

a link member pivotally connected at a first end to a respective said latch member and pivotally connected at a second end to an inner facing side of a respective said inner leg; and manual latch release means connected with said transverse rung operable to engage said hooks of said latch members with said arcuate catch elements when said chair is raised to prevent pivotal movement of said inner and outer legs and to disengage said hooks therefrom to allow pivotal movement of said inner and outer legs;

in a raised high chair configuration, said hooks of said latch members engaged with said arcuate catch elements to secure said first end of said inner legs engaged against said bottom surface of respective said lateral side members near a rear thereof and a first end of said outer legs engaged on the underside of said seat, and pivotal movement of said inner and outer legs is prevented; and to lower said chair to a rocking chair configuration, said hooks of said latch members are disengaged from said arcuate catch elements and as said chair is lowered, said outer legs pivot about their pivot connection with said lateral side members, and said inner and outer legs pivot about their said mutual pivot connection in a scissors fashion and said inner and outer legs form rockers with said curved bottom of said lateral side members resting on a curved top surface of said inner legs and said outer legs disposed parallel with said inner legs.

2. The chair according to claim 1, wherein each said link member is pivotally and movably connected at its said first end to a respective said latch member intermediate said latch member forward end and rear end to allow said latch member to pivot a short distance relative to said link as said hook is engaged and disengaged with said arcuate catch element.

3. The chair according to claim 1, wherein said depending laterally opposed vertical legs are spaced inwardly from lateral sides of said seat; and in said raised high chair configuration, a first end of each of said outer legs is engaged on the underside of said seat, and an upper portion of each of said outer legs is disposed laterally adjacent to said vertical legs, such that a forward portion of said seat is disposed between said upper portion of said outer legs to provide stable support.

4. The chair according to claim 1, wherein said manual latch release means comprises a rod extending slidably through an eye secured to said chair having a lower end pivotally connected with said transverse rung and a knob fixed to an upper end above said eye; and a compression spring mounted on said rod having a first end fixed to said rod and a second end biased against said eye to normally urge said transverse rung and said latch member rear ends downwardly under spring pressure; and as said chair is raised from said rocking chair configuration to said high chair configuration, said first ends of said inner legs pass forwardly beneath said hooks of said latch members and an outer surface of said arcuate catch elements slides forwardly against an underside of said hooks, raising said latch member rear ends said transverse rung upwardly against the pressure of said spring, and as a back end of said arcuate catch elements clears the underside of said hooks, the spring pressure causes said hooks to snap downwardly and engage said arcuate catch elements; and said latch members are manually disengaged from said arcuate catch elements by pulling said rod upward against the pressure of said spring such that said transverse rung and said rear ends of said latch members are pivoted upwardly in an arc and said hooks become disengaged from said back end of said arcuate catch elements to release said first end of said inner legs.

5. The chair according to claim 1, further comprising:

a pair of generally L-shaped arms pivotally connected at upper ends to lateral sides of said back rest having lower ends extending forwardly laterally adjacent to said arm rests; and a generally rectangular tray secured transversely across a top forward portion of said lower ends;

said L-shaped arms and said tray being pivotal upward and rearward to permit access to said seat.

* * * * *